US006644281B2

(12) United States Patent
Boehland

(10) Patent No.: US 6,644,281 B2
(45) Date of Patent: Nov. 11, 2003

(54) FUEL INJECTION APPARATUS FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/287,583

(22) Filed: Nov. 5, 2002

(65) Prior Publication Data

US 2003/0089340 A1 May 15, 2003

(30) Foreign Application Priority Data

Nov. 8, 2001 (DE) ..... 1 01 54 802

(51) Int. Cl.[7] ..... F02M 37/04
(52) U.S. Cl. ..... 123/467; 123/300; 239/88
(58) Field of Search ..... 123/300, 299, 123/467, 504, 496, 500, 501; 239/88–96

(56) References Cited

U.S. PATENT DOCUMENTS 5,711,277 A * 1/1998 Fuseya ..... 123/496
5,771,865 A * 6/1998 Ishida ..... 123/467
5,862,793 A * 1/1999 Jay et al. ..... 123/467
5,890,471 A * 4/1999 Nishimura ..... 123/467
5,893,350 A * 4/1999 Timms ..... 123/467
6,085,719 A * 7/2000 Heinz et al. ..... 123/300
6,189,509 B1 * 2/2001 Froment ..... 123/467
6,244,245 B1 * 6/2001 Boecking ..... 123/300
6,457,453 B1 * 10/2002 Tanabe et al. ..... 123/300
6,491,017 B1 * 12/2002 Mahr et al. ..... 123/299

* cited by examiner

*Primary Examiner*—Carl S. Miller
(74) *Attorney, Agent, or Firm*—Ronald E. Greigg

(57) ABSTRACT

For each cylinder of the internal combustion engine, the fuel injection apparatus has a high-pressure fuel pump and a fuel injection valve connected to it. A pump piston of the high-pressure fuel pump defines a pump working chamber connected to a pressure chamber of the fuel injection valve, which has an injection valve member which controls the injection openings and which the pressure prevailing in the pressure chamber can move in an opening direction counter to a closing force. A first control valve controls a connection between the pump working chamber and a relief chamber, and a second control valve controls a connection between the relief chamber and a control pressure chamber, which is connected to the pump working chamber. A control piston, which acts on the injection valve member, has a surface area that is acted on by the pressure prevailing in the control pressure chamber and that is determined in such a way that with a closed second control valve, the force acting on the control piston when the fuel injection valve is open with a partial stroke of the injection valve member is sufficient to close the fuel injection valve, and with a maximal stroke of the injection valve member, this force is not sufficient to close the fuel injection valve.

8 Claims, 2 Drawing Sheets

FUEL INJECTION APPARATUS FOR AN INTERNAL COMBUSTION ENGINE

BACKGROUND OF THE INVENTION

1. Field of the Invention

The invention is directed to an improved fuel injection apparatus for an internal combustion engines.

2. Description of the Prior Art

A fuel injection apparatus of the type with which this invention is concerned is known from EP 0 987 431 A2. This fuel injection apparatus has a high-pressure fuel pump and a fuel injection valve connected to it for each cylinder of the internal combustion engine. The high-pressure fuel pump has a pump piston, which the engine sets into a stroke motion and which defines a pump working chamber. The fuel injection valve has a pressure chamber connected to the pump working chamber and an injection valve member, which controls at least one injection opening and which the pressure prevailing in the pressure chamber can move in the opening direction, counter to a closing force, in order to open the at least one injection opening. A first electrically actuated control valve is provided, which controls a connection between the pump working chamber and a relief chamber. A second electrically actuated control valve is also provided, which controls a connection between a control pressure chamber and a relief chamber. The pressure prevailing in the control pressure chamber acts on the injection valve member at least indirectly in a closing direction and the control pressure chamber is connected to the pump working chamber. For an injection of fuel, the first control valve is closed and the second control valve is opened so that high pressure cannot build up in the control pressure chamber and the fuel injection valve can open. When the second control valve is open, however, fuel drains out of the pump working chamber by means of the control pressure chamber, so that of the fuel quantity delivered by the pump piston, the fuel quantity available for injection is reduced and so is the pressure available for the injection. As a result, the efficiency of the fuel injection apparatus is less than optimal.

OBJECT AND SUMMARY OF THE INVENTION

The fuel injection apparatus according to the invention has the advantage over the prior art that for the fuel injection, when the injection valve member is opened with a maximal stroke, the second control valve can be closed so that no loss in fuel quantity and fuel pressure occurs during the injection, thus improving the efficiency of the fuel injection apparatus.

Advantageous embodiments and modifications of the fuel injection apparatus according to the invention are disclosed. In a simple way, one embodiment makes it possible that when the injection valve member is only opened with a partial stroke, due to the small through flow cross section and the resulting throttling action, the sealing surface of the injection valve member has less force exerted on it in the opening direction than when the injection valve member is opened with the maximal stroke, when the throttle action is less intense due to the greater through flow cross section and therefore the pressure and the force acting in the opening direction are greater. Another embodiment permits the control of a preinjection by means of the second control valve, and a further embodiment permits the control of a main injection by means of the second control valve. A further embodiment permits the control of the march of pressure during a main injection by means of the second control valve.

BRIEF DESCRIPTION OF THE DRAWINGS

The invention will be better understood and further objects and advantages thereof will become more apparent from the ensuing detailed description contained herein below, taken in conjunction with the drawings, in which.

DESCRIPTION OF THE PREFERRED EMBODIMENTS

Figure 1:
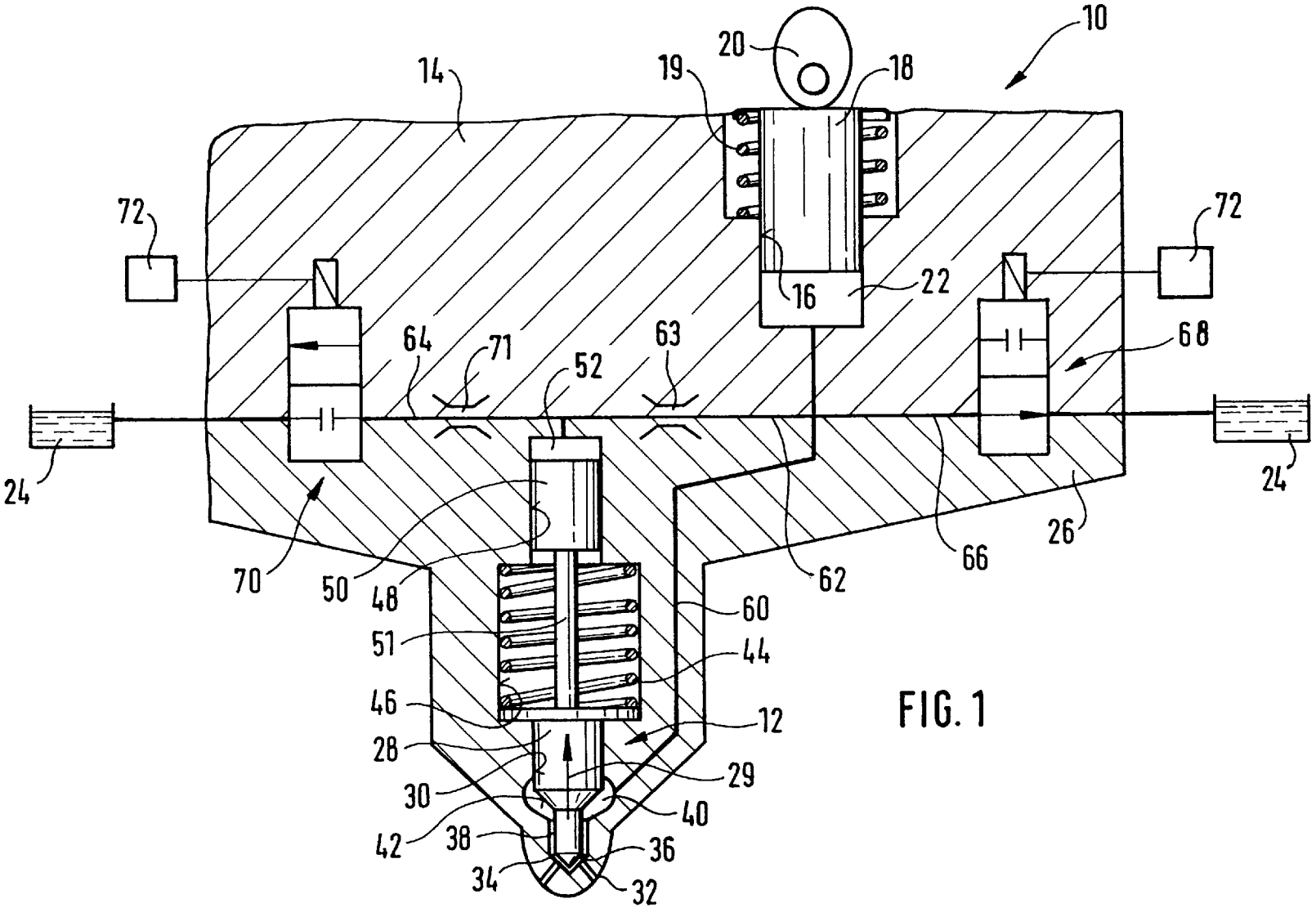
FIG. 1 schematically depicts a fuel injection apparatus according to the invention, for an internal combustion engine.
Figure 2:
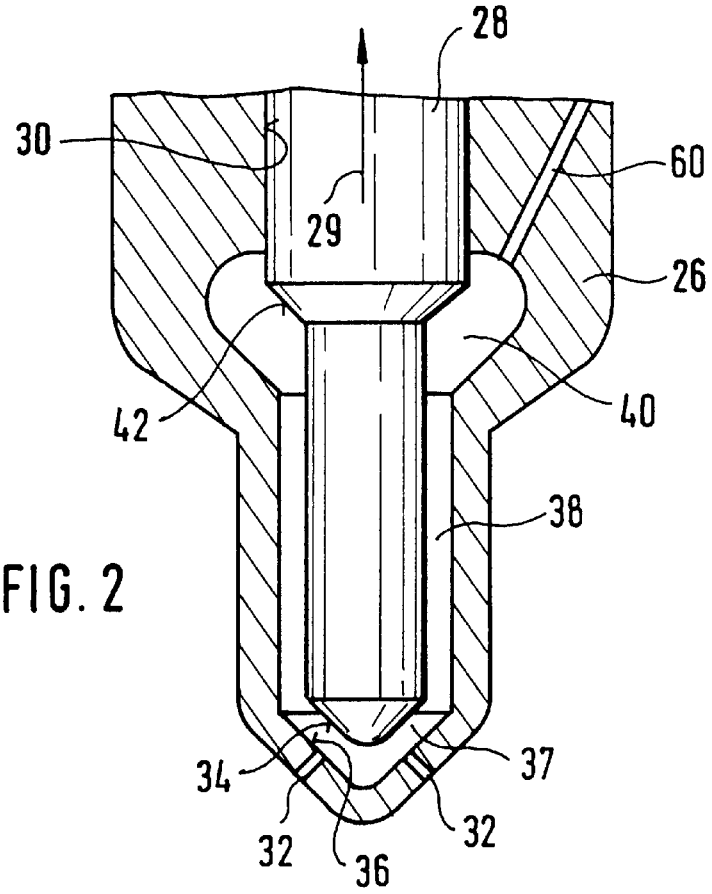
FIG. 2 shows an enlarged detail labeled 11 of the fuel injection apparatus.

FIGS. 1 and 2 show a fuel injection apparatus for an internal combustion engine of a motor vehicle. The engine is preferably embodied as a compression-ignition engine. The fuel injection apparatus is preferably embodied as a so-called unit injector and for each cylinder of the engine, has a high-pressure fuel pump 10 and a fuel injection valve 12 connected to it, which form a combined component. Alternatively, the fuel injection apparatus can also be embodied as a so-called unit pump system in which the high-pressure fuel pump and the fuel injection valve of each cylinder are disposed separately from each other and are connected to each other by means of a line. The high-pressure fuel pump 10 has a pump body 14 with a cylinder bore 16, in which a pump piston 18 is guided in a sealed fashion, and which is driven at least indirectly by a cam 20 of a camshaft of the engine to execute a stroke motion counter to the force of a restoring spring 19. In the cylinder bore 16, the pump piston 18 defines a pump working chamber 22 in which fuel is compressed under high pressure during the delivery stroke of the pump piston 18. The pump working chamber 22 is supplied with fuel from a fuel tank 24 of the motor vehicle.

The fuel injection valve 12 has a valve body 26, which is connected to the pump body 14 and can be comprised of several parts, and in which an injection valve member 28 is guided so that it can move longitudinally in a bore 30. In its end region oriented toward the combustion chamber of the engine cylinder, the valve body 26 has at least one, preferably several, injection openings 32. In its end region oriented toward the combustion chamber, the injection valve member 28 has a for example approximately conical sealing surface 34 that cooperates with a valve seat 36, which is embodied in the valve body 26 in its end region oriented toward the combustion chamber, and the injection openings 32 lead away from this seat or branch off downstream of it. In the valve body 26, between the injection valve member 28 and the bore 30 toward the valve seat 36, there is an annular chamber 38, which in its end region oriented away from the valve seat 36, transitions by means of a radial expansion of the bore 30 into a pressure chamber 40 that encompasses the injection valve member 28. At the level of the pressure chamber 40, the injection valve member 28 has a pressure shoulder 42 produced by a cross sectional reduction. A prestressed closing spring 44 acts on the end of the injection valve member 28 oriented away from the combustion chamber and presses the injection valve member 28 toward the valve seat 36. The closing spring 44 is disposed in a spring chamber 46 of the valve body 26, which chamber adjoins the bore 30.

At its end oriented away from the bore 30 in the valve body 26, the spring chamber 46 is adjoined by another bore 48, which has a control piston 50 guided in it in a sealed fashion, which is connected to the injection valve member 28. The bore 48 constitutes a pressure control chamber 52 defined by the control piston 50, which functions as a movable wall. The control piston 50 has a cross sectional area that is smaller than the cross sectional area of the injection valve member 28 in its region guided in the bore 30. The control piston 50 is connected to the injection valve member 28 by means of a piston rod 51 whose diameter is smaller than that of the control piston 50. The control piston 50 can be embodied of one piece with the injection valve member 28, but for assembly reasons, it is preferably embodied as a part that is separate from the injection valve member 28.

A conduit 60 leads from the pump working chamber 22, through the pump body 14, and the valve body 26, to the pressure chamber 40 of the fuel injection valve 12. A conduit 62 leads from the pump working chamber 22 or from the conduit 60 to the control pressure chamber 52. The control pressure chamber 52 is also connected to a conduit 64, which forms a connection to a relief chamber, which function can be at least indirectly fulfilled by the fuel tank 24 or another region in which a low pressure prevails. A connection 66 leads from the pump working chamber 22 or from the conduit 60 to a relief chamber 24 and this connection 66 is controlled by a first electrically actuated control valve 68. The control valve 68 can be embodied as a 2/2-port directional-control valve, as shown in FIG. 1. The connection 64 of the control pressure chamber 52 to the relief chamber 24 is controlled by a second electrically actuated control valve 70, which can be embodied as a 2/2-port directional-control valve. A throttle restriction 63 can be provided in the connection 62 of the control pressure chamber 52 to the pump working chamber 22; a throttle connection 71 can be provided in the connection of the control pressure chamber 52 to the relief chamber 24. The control valves 68, 70 can have an electromagnetic actuator or a piezoelectric actuator and are activated by an electronic control device 72.

If the fuel injection valve 12 is closed, then the injection valve member 28 rests with its annular sealing surface 34 against the valve seat 36. In this case, only the surface area of the pressure shoulder 42 of the injection valve member 28 has the pressure prevailing in the pressure chamber 40 exerted on it in the opening direction 29 and no other forces are exerted on the injection valve member 28 in the opening direction 29. If the fuel injection valve 12 is opened, then the sealing surface 34 of the injection valve member 28 lifts away from the valve seat 36 so that an annular through flow cross section 37 is opened up between the sealing surface 34 and the valve seat 36. If the sealing surface 34 of the injection valve member 28 is lifted away from the valve seat 36, then a pressure also acts on the end face of the injection valve member 28, i.e. the annular sealing surface 34 and the remaining area of the injection valve member 28 enclosed by it, which exerts a force on the injection valve member 28 in the opening direction 29. If the sealing surface 34 of the injection valve member 28 is disposed only a short distance from the valve seat 36 and consequently is only open by a partial stroke, then only a small through flow cross section 37 is unblocked, which throttles the fuel flowing through and causes a pressure drop. The end face of the injection valve member 28 is then exposed only to the pressure in the opening direction, which the throttling reduces in comparison to the pressure prevailing in the pressure chamber 40. If the injection valve member 28 executes its maximal stroke, then its sealing surface 34 is disposed a greater distance from the valve seat 36 so that a correspondingly greater through flow cross section 37 is opened up. A less intense throttling action occurs in the larger through flow cross section so that the end face of the injection valve member 28 is correspondingly exposed to a higher pressure in the opening direction 29. When the fuel injection valve 12 is open, consequently its injection valve member 28 is acted on not only by the force exerted on the pressure shoulder 42 by the pressure prevailing in the pressure chamber 40, but is also acted on by the force in the opening direction 29 exerted by the pressure acting on the end face of the injection valve member 28.

The cross sectional area of the control piston 50 acted on by the pressure prevailing in the control pressure chamber 52 is dimensioned so that with a closed second control valve 70 when the control pressure chamber 52 is disconnected from the relief chamber 24 and with the delivery stroke of the pump piston 18, high pressure builds up in the pump working chamber 22 and therefore also in the control pressure chamber 52, and in addition to the force of the closing spring 44, a force acting on the injection valve member 28 in the closing direction is produced, which is greater than the force acting on the injection valve member 28 in the opening direction 29 when the sealing surface 34 of the injection valve member 28, as explained above, is lifted away from the valve seat 36 by only a partial stroke. In this case, the fuel injection valve 12 is closed. If the sealing surface 34 of the injection valve member 28 is lifted away from the valve seat 36 by its maximal stroke, then the injection valve member 28 has a force exerted against it in the opening direction 29, which is greater than the force acting on the injection valve member 28 in the closing direction by means of the closing spring 44 and the pressure in the control pressure chamber 52 acting on the cross sectional area of the control piston 50 so that even when the second control valve 70 is closed, the fuel injection valve 12 cannot be closed if the first control valve 68 is closed and the pump working chamber 22 is consequently disconnected from the relief chamber 24. Although in FIG. 1, the diameter of the control piston 50 and the valve member 28 are schematically shown as being approximately equal, the cross sectional area of the control piston 50 is preferably less than the cross sectional area of the injection valve member 28, which is the sum of the area of its pressure shoulder 42 and the area of its end face.

Figure 3:
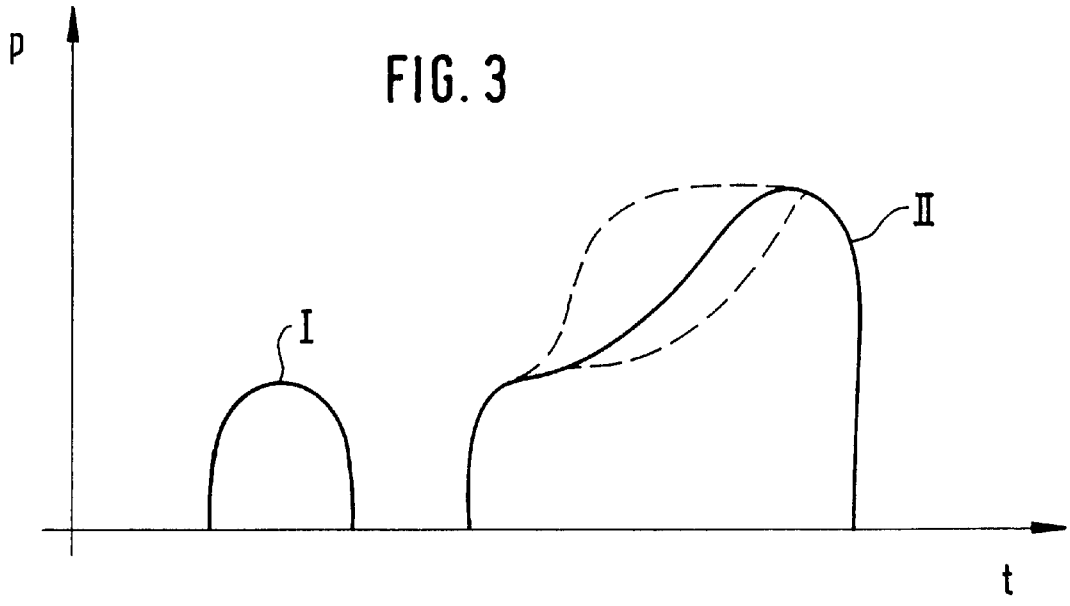
FIG. 3 shows a march of pressure at injection openings of a fuel injection valve of the fuel injection apparatus.

The function of the fuel injection apparatus will be explained below. FIG. 3 depicts the march of pressure p at the injection openings 32 of the fuel injection valve 12 over time t during an injection cycle. During the intake stroke of the pump piston 18, chamber 22 is supplied with fuel from the fuel tank 24. During the delivery stroke of the pump piston 18, the fuel injection begins with a preinjection, in which the first control valve 68 is closed by the control device 72 so that the pump working chamber 22 is disconnected from the relief chamber 24. The control device 72 also opens the second control valve 70 so that the control pressure chamber 52 is connected to the relief chamber 24. In this case, high pressure cannot build up in the control pressure chamber 52, since this chamber discharges into the relief chamber 24. However, a small quantity of fuel can drain out of the pump working chamber 22 to the relief chamber 24 by means of throttle restrictions 63 and 71 so that the full high pressure that would build up if the second control valve 70 were closed cannot build up in the pump working chamber 22. When the pressure in the pump working chamber 22 and therefore in the pressure chamber 40 of the fuel injection valve 12 is so great that the compressive force which it exerts on the injection valve member 28 by means of the pressure shoulder 42 is greater than the sum of the force of the closing spring 44 and the compressive force exerted on the control piston 50 by the residual pressure in the control pressure chamber 52, then the injection valve member 28 moves in the opening direction 29 and unblocks the at least one injection opening 32. The injection valve member 28 then opens with only a partial stroke so that only a relatively low pressure in the opening direction 29 is exerted on its end face. In order to terminate the preinjection, the control device closes the second control valve 70 so that the control pressure chamber 52 is disconnected from the relief chamber 24. The first control valve 68 remains in its closed position. As a result, high pressure builds up in the control pressure chamber 52 as it does in the pump working chamber 22 so that a powerful compressive force acts on the control piston 50 in the closing direction. Since as a result of the partial stroke of the injection valve member 28, only a slight force acts on it in the opening direction 29, which is less than the sum of the force of the closing spring 44 and the compressive force on the control piston 50, the fuel injection valve 12 closes. The preinjection corresponds to an injection phase labeled I in FIG. 3.

For a subsequent main injection, which corresponds to an injection phase labeled II in FIG. 3, the control device 72 opens the second control valve 70. The fuel injection valve 12 then opens due to the reduced compressive force on the control piston 50 and the injection valve member 28 executes its maximal opening stroke. When the injection valve member 28 is opened with its maximal opening stroke, then the control device 72 can close the second control valve 70 so that the control pressure chamber 52 is disconnected from the relief chamber 24. Then high pressure does in fact build up in the control pressure chamber 52 as it does in the pump working chamber 22, but the sum of the compressive force on the control piston 50 and the force of the closing spring 44 in the closing direction is less than the force in the opening direction 29 exerted on the pressure shoulder 42 and the end face of the injection valve member 28 that is opened with the maximal stroke so that the fuel injection valve 12 remains open. As long as the second control valve 70 is still open, the fuel injection occurs at a reduced pressure since a small quantity of fuel is draining out from the pump working chamber 22 to the relief chamber 24 via the open control valve 70. When the second control valve 70 is closed, then no more fuel can drain from the pump working chamber 22 so that the fuel injection occurs at a higher pressure, as shown in FIG. 3. The time at which the control device 72 closes the second control valve 70 is preferably varied as a function of operating parameters of the internal combustion engine, in particular as a function of its speed. It is thus possible to provide that at a low speed, the control device 72 closes the second control valve 70 at an earlier time and as the speed increases, the control device 72 closes the second control valve 70 at a later time. This can be used to limit the maximal pressure of the fuel injection at high speeds.

In order to terminate the main injection, the control device 72 moves the first control valve 68 into its open switched position so that the pump working chamber 22 is connected to the relief chamber 24 and only a low compressive force acts on the injection valve member 28 in the opening direction 29 and the fuel injection valve 12 closes due to the force of the closing spring 44.

The foregoing relates to preferred exemplary embodiments of the invention, it being understood that other variants and embodiments thereof are possible within the spirit and scope of the invention, the latter being defined by the appended claims.

I claim:

1. A fuel injection apparatus for an internal combustion engine, the apparatus comprising a high-pressure fuel pump (10), a fuel injection valve (12) connected to the fuel pump for each cylinder of the engine, the high-pressure fuel pump(10) having a pump piston (18)driven by the engine into a stroke motion, which piston defines a pump working chamber (22) which is supplied with fuel from a fuel tank (24), each fuel injection valve (12) having a pressure chamber (40) connected to the pump working chamber (22) and an injection valve member (28) which controls at least one injection opening (32) and on which the pressure prevailing in the pressure chamber (40) acts in an opening direction (29) against a pressure surface (42) embodied on the injection valve member (28), the injection valve member (28) being movable counter to a closing force, in an opening direction (29) in order to unblock the at least one injection opening (32), a first control valve (68) that controls a connection (66) between the pump working chamber (22) and a relief chamber (24), a second control valve (70) that controls a connection (64) between a control pressure chamber (52) of the fuel injection valve and a relief chamber (24), the pressure prevailing in the control pressure chamber (52) at least indirectly acting on the injection valve member (28) in a closing direction and the control pressure chamber (52) being connected to the pump working chamber (22), and a control piston (50) in the control pressure chamber (52), which piston acts on the injection valve member (28) and which has a surface area that is acted on by the pressure prevailing in the control pressure chamber (52), the surface area being determined such that with a closed second control valve (70) when the control pressure chamber (52) is disconnected from the relief chamber (24), the force acting on the control piston (50) when the fuel injection valve (12) is open with only a partial stroke of the injection valve member (28) is sufficient to close the fuel injection valve (12) and when the fuel injection valve (12) is open with a maximal stroke of the injection valve member (28), this force is not sufficient to close the fuel injection valve (12).

2. The fuel injection apparatus according to claim 1, wherein the injection valve member (28) has a sealing surface (34) with which it cooperates with a valve seat (36) in order to control the at least one injection opening (32), wherein when the fuel injection valve (12) is open, a through flow cross section (37) is produced between the sealing surface (34) and the valve seat (36), from the pressure chamber (40) to the at least one injection opening (32), wherein when the fuel injection valve (12) is open, pressure is exerted in the opening direction (29) on an end face of the injection valve member (28) in addition to the pressure surface (42), and wherein a throttling of the fuel flowing through occurs in the through flow cross section (37) as a function of the injection valve member (28) stroke.

3. The fuel injection apparatus according to claim 1 wherein in order to execute a preinjection of fuel, the control device (72) closes the first control valve (68) and opens the second control valve (70) so that the pump working chamber

(22) is disconnected from the relief chamber (24) and the control pressure chamber (52) is connected to the relief chamber (24), wherein the fuel injection valve (12) only opens with a partial stroke of the injection valve member (28) during the preinjection, and wherein the preinjection is terminated in that the control device (72) closes the second control valve (70) so that the control pressure chamber (52) is disconnected from the relief chamber (24), wherein the first control valve (68) remains closed.

4. The fuel injection apparatus according to claim 2 wherein in order to execute a preinjection of fuel, the control device (72) closes the first control valve (68) and opens the second control valve (70) so that the pump working chamber (22) is disconnected from the relief chamber (24) and the control pressure chamber (52) is connected to the relief chamber (24), wherein the fuel injection valve (12) only opens with a partial stroke of the injection valve member (28) during the preinjection, and wherein the preinjection is terminated in that the control device (72) closes the second control valve (70) so that the control pressure chamber(52) is disconnected from the relief chamber(24), wherein the first control valve (68) remains closed.

5. The fuel injection apparatus according to claim 3, wherein, for a main injection of fuel following the preinjection, the control device (72) opens the second control valve (70) so that the control pressure chamber (52) is connected to the relief chamber (24) and wherein after the beginning of the main injection, when the fuel injection valve (12) is opened with the maximal stroke of the injection valve member (28), the control device (72) closes the second control valve (70) so that the control pressure chamber (52) is disconnected from the relief chamber (24).

6. The fuel injection apparatus according to claim 4, wherein, for a main injection of fuel following the preinjection, the control device (72) opens the second control valve (70) so that the control pressure chamber (52) is connected to the relief chamber (24) and wherein after the beginning of the main injection, when the fuel injection valve (12) is opened with the maximal stroke of the injection valve member (28), the control device (72) closes the second control valve (70) so that the control pressure chamber (52) is disconnected from the relief chamber (24).

7. The fuel injection apparatus according to claim 5 wherein the time at which the control device (72) closes the second control valve (70) after the onset of the main injection is controlled variably as a function of operating parameters of the engine, in particular as a function of its speed.

8. The fuel injection apparatus according to claim 6 wherein the time at which the control device (72) closes the second control valve (70) after the onset of the main injection is controlled variably as a function of operating parameters of the engine, in particular as a function of its speed.

* * * * *